United States Patent [19]

Dürr et al.

[11] 4,190,371

[45] Feb. 26, 1980

[54] APPARATUS FOR DISCONTINUOUS MIXING OF AT LEAST TWO MATERIALS

[75] Inventors: Herbert Dürr, Viernheim; Helmut Müller, Mannheim, both of Fed. Rep. of Germany

[73] Assignee: Draiswerke GmbH, Mannheim-Waldhof, Fed. Rep. of Germany

[21] Appl. No.: 971,045

[22] Filed: Dec. 19, 1978

[30] Foreign Application Priority Data

Dec. 22, 1977 [DE] Fed. Rep. of Germany ..... 2757486

[51] Int. Cl.[2] ..... B01F 7/16; B01F 13/06

[52] U.S. Cl. ..... 366/139; 366/294; 366/309

[58] Field of Search ..... 366/294, 295, 293, 296, 366/309, 312, 139, 262, 263, 264, 265, 267, 302, 303, 311, 304

[56] References Cited

U.S. PATENT DOCUMENTS

| | | | |
|---|---|---|---|
| 1,415,735 | 5/1922 | Trust | 366/309 |
| 3,271,194 | 9/1966 | Oikawa | 366/293 |
| 3,969,314 | 7/1976 | Grigull | 366/139 |
| 3,984,001 | 10/1976 | Nagand | 366/293 |
| 4,091,457 | 5/1978 | Slywka | 366/309 |
| 4,107,792 | 8/1978 | Durr | 366/302 |

*Primary Examiner*—Robert W. Jenkins
*Attorney, Agent, or Firm*—Browdy and Neimark

[57] ABSTRACT

An apparatus for discontinuous mixing of substances, one of which is a liquid and especially suitable for the mixing of thixotropic materials. The mixer has a high speed rotor which cooperates with a more slowly rotating stator. Both rotor and stator are provided with teeth disposed on mutually concentric circles. When the teeth move past one another, shearing slots are formed. The drive shaft carrying the stator also carries at least one radially extending arm on which is mounted a wall scraper whose angle of attack with respect to the wall may be changed by rotation about an internal axis.

6 Claims, 1 Drawing Figure

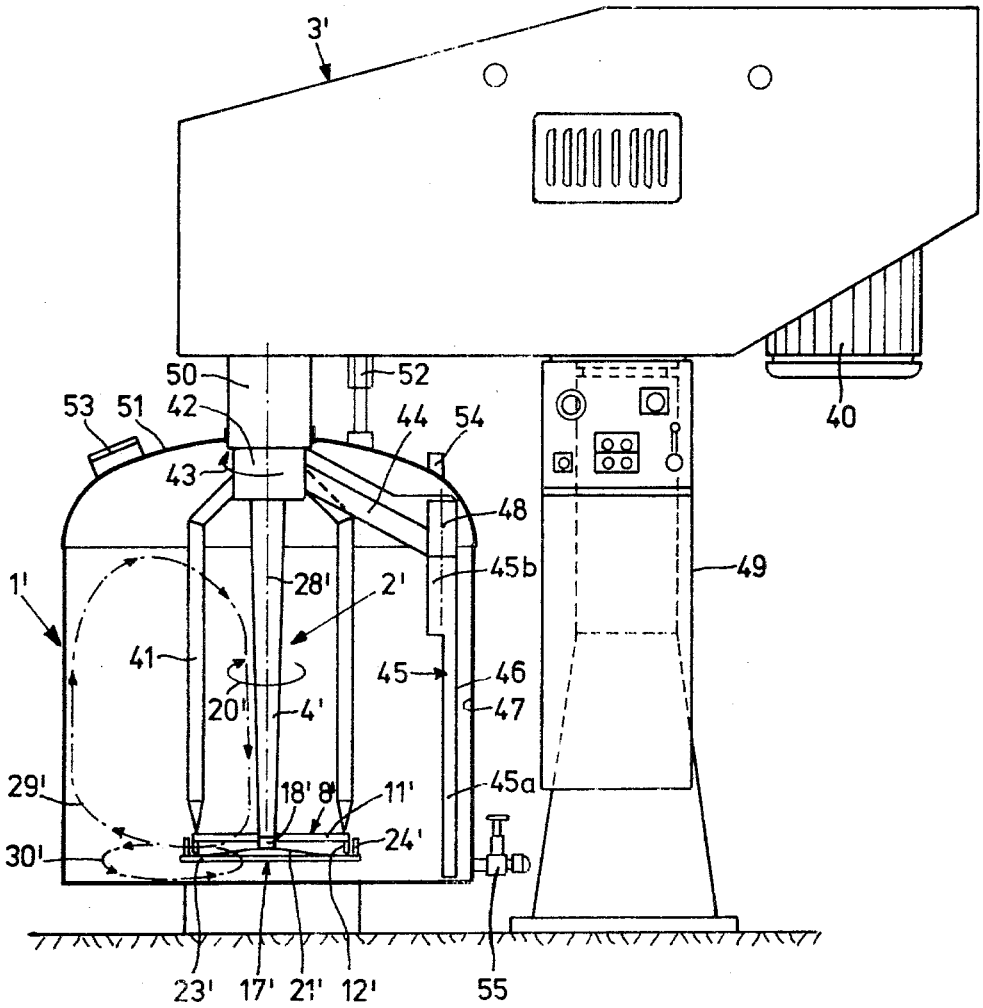
3'
50
52
53
51
42
44
54
40
43
48
1'
28'
2'
45b
49
41
45
46
20'
4'
47
29'
18'
8'
11'
45a
30'
24'
23'
17'
21'
12'
55

APPARATUS FOR DISCONTINUOUS MIXING OF AT LEAST TWO MATERIALS

CROSS REFERENCE TO RELATED PATENT

U.S. Pat. No. 4,107,792.

BACKGROUND OF THE INVENTION

This invention relates to an apparatus for the discontinuous mixing of at least two materials, at least one of which is a liquid. More particularly, the invention relates to a mixing apparatus which includes a container and a mixer disposed therein, the mixer having a first rotor which is driveable at high speed through a shaft, and a second rotor which replaces a stator and is driven at a lower speed, both the first rotor and the stator having teeth which cooperate by being positioned on mutually concentric but axially separate circles and which move past one another on circles of different radii to define shearing slots.

An apparatus of the type to which this invention relates and of which it is an improvement is described in U.S. Pat. No. 4,107,792. It is a particular feature of the mixing apparatus described in the aforementioned patent that the radially farther outward circle of teeth on the rotor is disposed outside of the radially outwardly located circle of teeth on a stator. It has been found in the arrangement of the rotor relative to the stator as described in the aforementioned patent that, when solids are dispersed in liquids, the dispersal time is reduced to one fifth of the time required when using previously known types of apparatus. The total amount of energy required for a mixing process is simultaneously reduced by 75 to 80 percent of the energy expenditure which would otherwise be required. By disposing the radially outwardly lying circle of teeth of the rotor externally of the radially outwardly lying circle of teeth of the stator, the individual material particles and drops of fluid acquire a high tangential acceleration due to contact with the radially outwardly lying teeth of the rotor after passing the radially outwardly lying shear slots. The high tangential acceleration leads to the formation of pronounced circular flow patterns which guide all the small particles and/or droplets more often into the rotor-stator system so that all the particles are subjected to very high hydrodynamic shear stresses. Many other advantages and favorable effects are derived from the disposition of stator and rotor as described in the aforementioned patent and these descriptions are incorporated in the present disclosure by reference. One of the advantages of the design according to the U.S. Pat. No. 4,107,792 is that cavitation phenomena develop in the shearing slots between the rotor and the stator. Advantageously also, the teeth of the rotor and the corresponding teeth of the stator have the same axial extent and are mounted parallel to each other. Preferably, the teeth on both rotor and stator are in the form of pins.

The use of mixing apparatus in practice has shown that the dispersal of thixotropic materials in fluids is made more difficult because the above-mentioned well-defined circular fluid flows did not appear.

In order to improve the mixing characteristics for thixotropic materials, it has been proposed in a prospectus entitled "Drais Planetary Kneader Mixers", published by Draiswerke GmbH, West Germany, to mount the radially most outwardly lying row of teeth on the stator and, in addition thereto, to provide supplementary mixing tools driven by planetary gears, each supplementary mixing tool being attached to one planetary gear of the planetary gear train. Furthermore, movable strippers are disposed in the vicinity of the interior wall of the container.

The use of this planetary mixer which employs the combination of a movable scraper or stripper, together with the above-described principal mixer consisting of a rotor and stator, has shown that the mixing of thixotropic materials remains unsatisfactory.

SUMMARY OF THE INVENTION

It is thus a principal object of the present invention to provide an apparatus for mixing at least two materials with a decreased energy input and a reduction of the mixing time. It is an associated object of the present invention to provide a mixing apparatus in which the aforementioned advantages are obtained when at least one of the materials to be mixed is a thixotropic material.

The foregoing object as well as others which are to become clear from the text below, is achieved according to the invention by virtue of the fact that the mixing apparatus is provided with a second rotating shaft coaxial with and rotating in the same sense as the principal rotating shaft carrying the first rotor, and wherein the secondary rotating shaft carries a unit which replaces the stator as well as a scraper located and moving in the vicinity of the interior wall of the mixing container. The unit, hereinbelow referred to as a second rotor rotates at a lower angular velocity than the conventional rotor, hereinbelow referred to as the first rotor. It has been found, surprisingly, in using the apparatus of the invention which includes, in addition to the first rotor and the second rotor, only scrapers rotating slowly in the vicinity of the interior wall of the container but does not include any supplementary mixing tools, that the forced mingling of the materials is optimized. A possible explanation for this fact is that the supplementary mixing tools, for example the aforementioned planetary mixing tools, may actually disturb and diminish the circular fluid flows generated by the rotor-rotor system, whereas these circular flows are enhanced when only scrapers are present. It should be noted that the construction according to the present invention is advantageous even when non-thixotropic materials are mixed and will lead to a substantial reduction of the mixture time because all of the particles and droplets of the materials to be mixed participate in the forced motion in a statistically more uniform manner so that each particle or droplet completes the required number of passages through the shearing slots of the rotor-rotor system substantially sooner. The second rotor of the present invention actually rotates but its speed of rotation is substantially slower than that of the first rotor and has consequently stator-like characteristics to a considerable degree.

Advantageously, the second rotating shaft carrying the second rotor and the wall scraping attachment is a hollow shaft which coaxially surrounds the principal drive shaft of the first rotor.

Advantageously, the speed of rotation of the principal shaft is 7–70 times greater than the speed of rotation of the drive shaft to which the second rotor and the wall scraper are attached. In an advantageous feature of the invention, the radial extent of the scraper increases toward the top of the container, thereby causing an increased flow of materials toward the central shaft in the vicinity of the top part of the container.

BRIEF DESCRIPTION OF THE DRAWINGS

Further advantages and features of the invention will be apparent from the description of an embodiment with reference to the drawing.

The single FIGURE of the drawing is a side-elevational view of an apparatus for mixing materials according to the invention in partial vertical cross section. Reference numerals referring to parts identical with those of FIG. 1 in U.S. Pat. No. 4,107,792 are marked with primes.

DESCRIPTION OF THE PREFERRED EMBODIMENT

An apparatus for mixing materials according to the present invention is provided with a substantially cylindrical container 1' open at the top, into which a mixer 2' is inserted from above. The mixer 2' is provided with a shaft 4' on a suspension mount in a housing 3' indicated generally, the shaft being driveable at high speed by a drive motor 40. The lower, free end of the shaft 4' carries first rotor 17' consisting of a hub 18' coupled to the end of the shaft 4' and, extending therefrom, substantially radial, propeller-like rotor arms 21' the ends of which carry an annular disc 23'. Mounted vertically on the disc 23' are teeth 24' in the form of pins disposed parallel to one another at regular intervals around the periphery of the disc 23'. An annular disc 11' which is part of a second rotor unit 8' is disposed in the plane defined by the upper ends of the teeth 24' and also carries a row of equally spaced teeth 12' in the form of pins. The pins 12' extend downwardly from the annular disc 11' to the immediate vicinity of the surface of the annular disc 23'. The annular disc 11' of the second rotor 8' is held in its position by arms 41 disposed substantially parallel to the principal rotor shaft 4' and attached at their other end to a hollow shaft 42 which is concentric with and surrounds the shaft 4' of the first rotor 17'. The sense of rotation of the hollow shaft 42 is the same, as indicated by the arrow 43, as the sense of rotation of the shaft 4' of the first rotor 17' as indicated by the arrow 20'.

Further attached to the hollow shaft 42 is a radially extending carrier arm 44 whose radially remote, free end carries a downwardly extending scraper 45 having a radially remote scraping edge 46 which may be in contact with the interior cylindrical wall 47 of the container 1' or at least lies in the immediate vicinity of that surface. The scraping attachment 45 may be rotated about an internal axis 48, thereby adjusting its angular position with respect to the carrier arm 44 as well as with respect to the prevailing tangent to the interior wall 47 of the container 1'. The hollow shaft 42 carrying the scraper 45 and the second rotor 8' is also rotated by the drive motor 40 at a constant speed which, depending on the dimensions of the apparatus may lie between 10 and 25 rpm.

The rotational speed of the central shaft 4' which carries the first rotor 17' is substantially higher. The higher speed of rotation of the shaft 4' is obtained by the interposition of a steplessly controllable transmission (not shown) located within the housing 3'. In very large installations, the speed range which may be selected is between 150 and 500 rpm, whereas it may be for example between 500 and 1500 rpm in relatively small installations.

The preferred rotational speed of the shaft 4' and its first rotor 17' is thus seen to be from 7–70 times greater than the speed of rotation of the hollow shaft 42 carrying the second rotor 8' and the scraper 45.

The relative disposition of the stator teeth 12' and the rotor teeth 24' is as described in U.S. Pat. No. 4,107,792. As stated therein, the teeth 24 are in the form of pins having the same diameter and the same length as the teeth 12, also made in the form of pins. The two sets of teeth overlap in their lengthwise directions, as seen in FIG. 1 so that, when one tooth 24' on the rotor 17' passes the tooth 12' on the second rotor 8', a shearing slot is formed whose width can be several millimeters. The teeth 12', 24', are positioned axially parallel to the axis of rotation 28' of the shaft 4'. Similarly, the effects due to this disposition of the teeth and due to the relatively rapid rotation of the rotor teeth 24' which radially surround the rotor teeth 12', are virtually the same as obtained in the apparatus described in the aforementioned patent. Due to the high circumferential speed of the first rotor 17', which may be as high as 50 m/sec, the materials in the container 1' acquire a very high tangential acceleration which tends to generate a well-defined circular flow which is illustrated in the figure by flow lines 29' and 30'. It will be appreciated that, while the figure shows only those components of motion of the flow which occur in a vertical section, the motion would actually have rotational components which cannot be shown. In practice, the flow pattern is invariably three-dimensional. The existence of these flow patterns is further enhanced by the presence of the scraper 45 due to the fact that the scraper 45 increases the return flow of particles from the radially outward region of the container 1' toward the central shaft 4'. This return flow leads to an increased circulation of the individual particles so that they tend to pass the shearing slots formed between the teeth 12' and 24' still more often than would otherwise be the case. Furthermore, the presence of the scraper 45 prevents the deposition of any material on the wall 47, which materials might otherwise be lost to the forced circulation. The increased return flow due to the scraper is the result of an increase in the radial extent of the scraper toward the top of the container. In the simplest embodiment, the scraper 45 has a lower region 45*a* and an upper region 45*b* of greater radial extent than the lower region. Accordingly, the scraper exerts increased return flow forces on the fluid toward the central axis 28' in a region where the flow would tend to be the least agitated. The fact that both shafts rotate in the same sense brings the advantage that the scraper does not have to operate in opposition to the established rotational flows described above but moves in the same direction as these flows, thereby substantially reducing the energy requirements for driving the hollow shaft 42 carrying the scraper 45 and the second rotor 8'.

The housing 3' which houses the drive motor 40, the shaft 4' and the hollow shaft 42 may be mounted in known manner on a pedestal 49 whose height may be adjustable, permitting the housing 3' to be moved upwardly as far as necessary to remove the mixing system 2' completely from the container 1'. The open top of the container 1' may be closed by a cover 51 mounted on a non-rotatable guide tube 50 concentrically surrounding the hollow shaft 42. The cover 51 may also be moved axially by means of a hydraulic drive mechanism 52. The cover 51 may be vacuum-sealed with respect to the container 1' in known manner. The cover 51 is provided with a vacuum sealable filler opening 53 and an evacuation valve 54. The lower part of the container 1' has an outlet valve 55.

Due to the construction of the mixing apparatus of the present invention, which includes a slowly rotating scraper 45, it is no longer necessary, as was heretofore required, to cause the mixer 2' to execute an axial oscillatory (up and down) motion within the container 1'. This oscillatory motion required a substantial expenditure and introduced substantial sealing problems during vacuum operation because of the requirement of having to seal the cover 51 with respect to the shaft 4' in both rotary and axial motion. Accordingly, the construction of the present invention is particularly advantageous when the mixing apparatus is used in vacuum operation.

It is to be understood that the foregoing description as well as the accompanying drawing relate to an illustrative embodiment of an apparatus set out by way of example and not by way of limitation. Numerous other embodiments and variants are possible without departing from the spirit and scope of the invention.

What is claimed is:

1. An apparatus for discontinuous mixing of at least two substances, of which at least one is a liquid, the apparatus comprising a container, a mixer disposed in the container, said mixer having a first rotor driveable at high speed through a first shaft a second rotor, and respective teeth disposed on said first rotor and said second rotor in mutually concentric circles for movement past one another to form shearing slots, and at least a circle of teeth located farther outward radially on said first rotor being disposed radially outside a circle of teeth on said second rotor, wherein the apparatus is provided with a secondary drive shaft for imparting rotation of said second rotor at a rotational speed substantially lower than the contemporaneous speed of rotation of said first rotor, and wherein said secondary drive shaft carries a scraper positioned in the vicinity of the interior wall of said container.

2. An apparatus according to claim 1, wherein said secondary shaft is a hollow shaft coaxial with and concentrically surrounding the rotor shaft.

3. An apparatus according to claims 1 or 2, wherein means are provided for imparting to said first shaft a rotational speed in the range of 7–70 times greater than the rotational speed of said secondary shaft carrying said second rotor and said scraper.

4. An apparatus according to claim 1, wherein the sense of rotation of said first shaft and said secondary drive shaft is the same.

5. An apparatus according to claim 1, wherein said scraper is shaped so as to provide increased flow in the topmost region thereof.

6. An apparatus according to claim 1, further comprising a cover (51) for sealing said container (1') in vacuum-tight manner, said cover (51) being provided with means for evacuating air from said container.

* * * * *